United States Patent [19]

Vandame

[11] Patent Number: 4,734,052

[45] Date of Patent: Mar. 29, 1988

[54] ELECTRICAL CONNECTOR

[75] Inventor: Bertrand Vandame, Villepreux, France

[73] Assignee: Precision Mecanique Labinal, Bois D'Arcy, France

[21] Appl. No.: 880,888

[22] Filed: Jul. 1, 1986

[30] Foreign Application Priority Data

Jul. 4, 1985 [FR] France ..... 85 10219

[51] Int. Cl.[4] ..... H01R 13/28

[52] U.S. Cl. ..... 439/293; 439/342; 439/354; 439/595

[58] Field of Search ..... 339/47 R, 48, 49 R, 339/49 B, 59 R, 59 M, 75 M, 91 R; 439/342, 353, 354, 285, 289, 292, 293, 595

[56] References Cited

U.S. PATENT DOCUMENTS

| | | | |
|---|---|---|---|
| 3,145,067 | 8/1964 | Mishelevich | 339/75 M |
| 3,217,285 | 11/1985 | Barre | 339/49 |
| 3,310,772 | 3/1967 | Kirk et al. | 339/91 R |
| 3,461,258 | 8/1969 | Shlesinger, Jr. | 339/91 R |
| 3,676,833 | 7/1972 | Johnson | 339/49 R |
| 3,688,243 | 8/1972 | Yamada et al. | 339/49 R |
| 3,848,222 | 11/1974 | Lightner | 339/75 M |
| 4,075,444 | 2/1978 | Hollingsead et al. | 339/75 M |
| 4,124,264 | 11/1978 | Kato et al. | 339/59 M |

FOREIGN PATENT DOCUMENTS

| | | | |
|---|---|---|---|
| 2217827 | 9/1974 | France . | |
| 2269807 | 11/1975 | France . | |
| 2269216 | 11/1976 | France . | |
| 2344979 | 10/1977 | France . | |
| 2497413 | 7/1982 | France | 339/49 R |
| 2535910 | 11/1984 | France . | |

*Primary Examiner*—John McQuade
*Attorney, Agent, or Firm*—Sandler & Greenblum

[57] ABSTRACT

An electrical connector including a first box element and a second box element, each box element receiving an electrical contact and the other box element when one of the box elements is inverted head-to-tail upside down with respect to the other box element. Each element includes male and female portions. The male portion includes a locking lug having an elastic portion and a stiff rounded portion. The female portion includes a joggle. The joggle of each element is adapted to engage the locking lug of the other element during assembly of the first and second elements along an insertion axis. When this occurs the joggle will climb up the stiff rounded portion of the locking lug thereby displacing the first and second elements in opposite directions perpendicular to the insertion axis. Further displacement along the insertion axis displaces the joggle into contact with the elastic portion which bends, so as to displace the two elements closer to each other perpendicular to the insertion axis. The initial displacement perpendicular to the insertion axis of the first and second elements away from each other ensures that the electrical contacts in each box element are initially separated from each other so that there is no damage to these elements. These two electrical contacts are then brought together for engagement with each other to form an electrical connection when the first and second elements are displaced toward each other as the joggle contacts the elastic portion of the locking lug.

31 Claims, 15 Drawing Figures

ELECTRICAL CONNECTOR

CROSS-REFERENCE TO RELATED APPLICATIONS

Reference is made to the following related copending applications of Applicant: Ser. No. 758,440 filed July 24, 1985 now U.S. Pat. No. 4,664,460; Ser. No. 816,626 filed Jan. 6, 1986, now U.S. Pat. No. 4,655,527; Ser. No. 701,180 filed Feb. 13, 1985, now U.S. Pat. No. 4,564,259; Ser. No. 865,018 filed May 20, 1986, allowed by not as yet issued; and Ser. No. 88,847, filed July 7, 1986. Each of these applications are hereby incorporated by reference.

BACKGROUND OF THE INVENTION

1. Field of the Invention

The invention relates to electrical connectors of the "hermaphroditic" type, i.e. composed of two substantially identical box elements one of which is turned "head-to-tail" upside down with respect to the other and fitted together. Each box element comprises a plurality of channels and each channel is adapted to receive a component of an electrical contact. Each contact is linked to a conductor, and the electrical contact components are complementary to each other so that those in one of the box elements are complementary to those in the other box element so that those in one of the box elements are adapted to engage those in the other of the box elements, and vice versa.

2. Description of Pertinent Information

In order to connect two electrical conductors, each electrical conductor is normally attached to an electrical contact. One of the electrical contacts attached to one of the conductors has a shape complimentary to the other contact so that the two contacts are adapted to engage each other when brought together. The two portions of the contacts that engage each other must be protected to protect the linkage of the two electrical conductors. This protection is normally accomplished by attaching each electrical contact to an electrical connector. Each electrical connector is adapted to engage another electrical connector so as to lock the two electrical connectors together and to protect the connection between the two electrical conductors. Electrical connectors usually comprise a plurality of channels, each of which are adapted to house one electrical contact component. Furthermore, each channel of the connector usually comprises means for locking the electrical contact components therein so as to retain the electrical contact components in the connector.

It is often the case, however, that even if great care is taken in manufacturing the electrical connectors and the electrical contact components, the configuration of these contact components are altered slightly so that they are not identical to each other as a result of placing and locking the electrical contact component in the channels of the connectors. As a result, when the two electrical contact components are assembled they may not fit together to provide an electrical link, but may abut each other in such as way as to be forced against each other during assembly, which can damage the electrical connector or the electrical contact components themselves, thereby resulting in a bad electrical connection. This disadvantage is even more noticeable when the connectors are very small and comprise a large number of channels housing a large number of electrical contact components.

Thus, there is a need for an electrical connector that does not damage itself or damage or alter the configuration of the electrical contact components housed therein during the assembly of two connectors.

SUMMARY OF THE INVENTION

It is an object of the present invention to remedy the disadvantages of the prior art.

It is a still further object of the present invention to provide an electrical connector that does not damage itself or damage or alter the configuration of the electrical contact components housed therein during assembly of the two electrical connectors. Each housing at least one electrical contact component.

The invention which achieves these objectives relates to an electrical connector. The connector comprises a first element adapted to receive electrical contacts and adapted to be connected to a second substantially identical element by displacement of the first and second elements toward each other along an engagement or insertion axis. The first element comprises a male portion and a female portion. The male portion is adapted to engage a female portion on the second element substantially identical to the female portion on the first element. Further, the female portion of the first element is adapted to receive a male portion of the second element substantially identical to the male portion of the first element. In addition, the male and female portions of the first element together comprise means for displacing the first and second elements in diverging directions substantially perpendicular to the engagement axis in response to the first and second elements being displaced toward each other along the engagement axis that the male portion of the first element engages the female portion of the second element and the female portion of the first element receives the male portion of the second element. In addition, the invention relates to such a connector in combination with the second element.

The first and second elements are adapted to be positioned in a normal assembly position in which an electrical contact housed in the first element engages an electrical contact housed in the second element. In this embodiment the connector further comprises means for displacing the first and second elements into their normal assembly position after the first and second elements are displaced in the diverging direction noted above by the male and female portions.

As the first and second elements are displaced toward each other along the engagement axis, the first and second elements are displaced from a first position to a second position and then to a third position along the engagement axis. In this embodiment, the first element comprises means for engaging a complimentary shaped portion on the second element during displacement along the engagement axis. As a result, in the first position, the engagement means on the first element begins to contact the complimentary shaped element on the second element. Further, at the first position the first and second elements are in their normal assembly position. In their second position, the male and female portions of the first element displace the first and second elements in opposite directions substantially perpendicular to the engagement axis and away from the normal assembly position. In addition, the normal assembly position displacing means comprises means for displacing the first and second elements back into their normal assembly position in response to displacement of the first and second elements from the second position to the third position along the engagement axis beyond the first position.

The diverging direction displacement means comprises a joggle on the male portion of the first element and a locking lug on the female portion of the first element. The joggle of the first element engages a locking lug on a male portion of the second element and the locking lug of the first element engages a joggle on a female portion of the second element so that the engagement of the locking lugs and the joggles of the first and second elements displaces the first and second elements in diverging directions substantially perpendicular to the engagement axis.

The male portion comprises two lateral walls each comprising a projecting bar comprising a free end comprising a ramp. The female portion comprises two lateral walls each comprising a slide having a shape complimentary to the projecting bar. The slide of the first element is adapted to slidingly receive a projecting bar of the second element in response to displacement of the second element along the engagement axis. The bar of the first element is adapted to slidingly engage a slide on the second element, and the engagement means comprises this projecting bar and the slide of the first element. The first and second elements are displaced into their normal assembly position in response to displacement of the elements from the second to the third position, thereby sliding the ramp of one of the elements into the slide of the other of the elements.

The first element further comprises means for connection to a second element substantially identical to the first element by inverting the first element head-to-tail upside down with respect to the second element. In this embodiment, when the first element is in this inverted position the bar of the first element is adapted to slidingly engage a slide of the second element and the slide of the first element is adapted to slidingly engage the bar of the second element. In addition, the locking lug and the joggle of said first element comprise means for displacing the first and second elements in opposite directions substantially perpendicular to the engaging axis. Also, in this inverted position of the first element with respect to the second element, the joggle of the first element is adapted to slidingly engage the locking lug of the second element. Also, in this inverted position of the first element with respect to the second element, the locking lug of the first element is adapted to slidingly engage the joggle of the second element and the ramp of the first element is adapted to slidingly engage the bar of the second element.

The locking lug comprises an elastic portion, and a stiff rounded portion connected to and extending in front of the elastic portion. In this embodiment the joggle of the second element first contacts the stiff rounded portion of the lug and then contacts the elastic portion of the lug in response to displacement of the first and second elements from their second to their third positions. As the first and second elements first contact each other during assembly the joggle climbs the rounded portion, thereby displacing the first and second element in opposite directions perpendicular to the engagement axis. After the joggle has climbed the stiff rounded portion of the lug and the elements are positioned in their third position the ramps of the first and second elements engage the slides of the second and first elements, respectively, so as to position the first and second elements in their normal assembly position.

The male portion comprises two additional walls spaced apart from each other. One of the additional walls is adjacent to the female portion. The other of the additional walls is opposite from the wall adjacent to the female portion. In this embodiment the stiff rounded portion of the lug is connected to the other of the additional walls, and the lug connects the elastic portion to the other of the additional walls. Also, the female portion further comprises two additional walls, spaced apart from each other. One of the additional walls of the female portion is adjacent to the male portion, and the other of the additional walls of the female portion is opposite from the wall adjacent to the male portion and comprises an internal face. In this embodiment the joggle is connected to the internal face of the other of the additional walls of the female portion.

The male and female portions each further comprise a plurality of channels. Each channel comprises means for receiving and housing a component of an electrical contact linked to an electrical conductor. Each contact housed in the male portion has a complimentary shape to a contact housed in the female portion. In addition, the invention comprises such a connector in combination with the electrical contact. Also, the connector further comprises a locking means for maintaining the first element assembled with the second element. In addition, the male portion can comprise a housing for housing the elastic portion of the lug and in which the elastic portion extends. Also, the lug can further comprise an intermediate slot. As the first and second elements are displaced toward each other along the engagement axis, the first and second elements are displaced from the third position noted above to a fourth locked position along the engagement axis. In this embodiment, the joggle of the second elements engages the slot in the first element and the slot of the first element engages the joggle on the second element after the joggles of the first and second elements have climbed the stiff rounded portion of the second and first elements, respectively, and after the first and second elements are displaced from the third to the fourth position. As a result, the joggle in the slot comprise the locking means noted above, and this locking means locks the first and second elements in the locked position in response to engagement of the slot of the first element with the joggle of the second element and in response to the engagement of the joggle of the first element with the slot of the second element.

In addition, the lug can further comprise a boss. The slot is positioned between the boss and the stiff rounded portion. The boss comprises means for freeing the joggle from the slot so as to unlock the first and second elements in response to pressing the boss downwardly.

The joggle can further comprise a rounded portion facing the exterior of the first element, an end facing the inside of the first element, and a stop positioned at this end and opposite from the rounded portion of the joggle.

The first element can also comprise means for housing and receiving hermaphroditic electrical contacts. The first element is adapted to house hermaphroditic contacts comprising a body comprising an end comprising means for attaching the contact to an electrical conductor. The body of the contact which is adapted to be housed by the first element comprises a rectangular section having a floor wall comprising an extension folded toward the inside of the body and further comprising an elastic lug turned toward the extension. In addition, the present invention relates to such a connector in combination with one of these hermaphroditic electrical contacts. Also, the contact which is adapted to be housed in the first element can further comprise an opening therein which is adapted to engage an elastic lug comprising a joggle positioned in each channel. Also, each contact which is adapted to be received in the channel of the first element comprises a free end, and each channel of the connector further comprises a stop adapted to abut this free end when the contact is assembled with the connector.

The other of the additional walls of the female portion comprises a free end spaced from the lateral walls of the female portion. In addition, the other of the additional walls of the male portion comprises a central portion in which the housing is positioned.

The joggle of the female portion is positioned in a plane passing through the locking lug of the male portion. In addition, one of the additional walls of the female portion in this embodiment comprises a free end having a forwardmost edge. The joggle is spaced behind this forwardmost edge of the free end of one of the additional walls of the female portion.

The invention also relates to the connector defined above in combination with the second element, and the present invention relates to first and second elements which are substantially boxed-shaped.

The invention also relates to a hermaphroditic electrical connector comprising a first element adapted to receive electrical contacts and adapted to be assembled with a second substantially identical element comprising a male element comprising a locking lug and a female element comprising a joggle by displacement of the first and second elements toward each other along an engagement axis. The first element is adapted to engage the second element when the second element is turned head-to-tail upside down with respect to the first element. The first element comprises a male portion and a female portion. The male portion comprises a locking lug comprising an elastic portion and a stiff rounded portion. The male portion comprises means for engaging the female portion of the second element. The female portion comprises a joggle, and means for receiving the male portion of the second element. The joggle of the first element comprises means for engaging the lug of the second element during assembly of the first and second elements, and lug of the first element comprises means for engaging the joggle of the second element during assembly of the first and second elements. The position of the joggle and the locking lug is such that at the beginning of the assembly of the first and second elements the joggle of the first element climbs the stiff rounded portion of the joggle of the second element, thereby displacing the first and second element in diverging directions substantially perpendicular to the engagement axis.

The male portion of the first and second elements further comprises at least one projecting bar comprising a sliding ramp, and the female portion of the first and second elements further comprises at least one slide. The at least one projecting bar and the at least one slide are positioned so that: the at least one projecting bar of the first element comprises means for engaging the slide of the second element, the at least one slide of the first element comprises means for receiving the at least one bar of the second element, and the ramp of the first element fits into the slide of the second element to bring the first and second elements to a normal assembly position in which an electrical contact attached to the first element engages an electrical contact attached to the second element.

The present invention also relates to the connector defined above in the above two paragraphs in combination with the second element. In this embodiment, the joggle of the second element comprises means for engaging the lug of the first element during assembly of the first and second elements, and the lug of the second element comprises means for engaging the joggle of the first element during assembly of the first and second elements. In addition, the position of the joggle, locking lug, and the slanting ramps, and the bar of the first and second elements are such that at the beginning of the assembly of the first and second elements the joggle of the second element climbs the stiff rounded portion of the first element, thereby displacing the first and second elements in diverging directions substantially perpendicular to the engagement axis. In addition, the at least one projecting bar of the second element comprises means for engaging the slide of the first element, and at least one slide of the second element comprises means for receiving the at least one bar of the first element. As a result, the ramp of the second element fits into the slide of the first elements to bring the first and second elements into a normal assembly position in which an electrical contact attached to the first element engages an electrical contact attached to the second element.

The first and second elements also comprise first and second box elements, and means for locking the first and second elements in an assembled position. In this embodiment the male and female portions of the first and second elements each further comprise first and second lateral walls, third and fourth additional walls, and a plurality of channels. Each channel comprises means for receiving a component of an electrical contact linked to an electrical conductor. The electrical contact housed in the male portions have a shape complimentary to the shape of the electrical contacts housed in the female portions. In addition, each lateral wall of the male portion comprises one projecting bar. Also, each lateral wall of the female portion comprises one slide. The third wall of the male portion is adjacent to the female portion, and the fourth wall of the male portion is opposite from the third wall of the male portion and comprises the locking lug. The fourth wall of the female portion corresponds to the fourth wall of the male portion and comprises an internal face on which the joggle is positioned.

The invention also relates to a hermaphroditic electrical contact comprising first and second ends, a first lug positioned at the first end so that the first lug attaching a sleeve of a conductor to the contact, a second lug for attaching a stripped end of the conductor to the contact, a floor comprising an extension comprising the second end of the contact, the extension being folded on itself to comprise an elastic tab, two lateral walls, and two flaps, each flap connected to a different lateral wall. The lateral walls extend above the floor, and the flaps are positioned above the floor and extends substantially parallel to the floor to form a substantially rectangular duct with the floor and the lateral walls. In addition, the floor can have an opening therein adapted to receive a joggle in the channel of an electrical connector. Also, the substantially rectangular duct extends from the second lug toward the second end of the contact.

BRIEF DESCRIPTION OF THE DRAWINGS

The invention will now be described in more detail in the detailed description which follows in conjunction with the attached drawings which are given by way of example only, and in which.

DETAILED DESCRIPTION OF PREFERRED EMBODIMENTS

Figure 1:
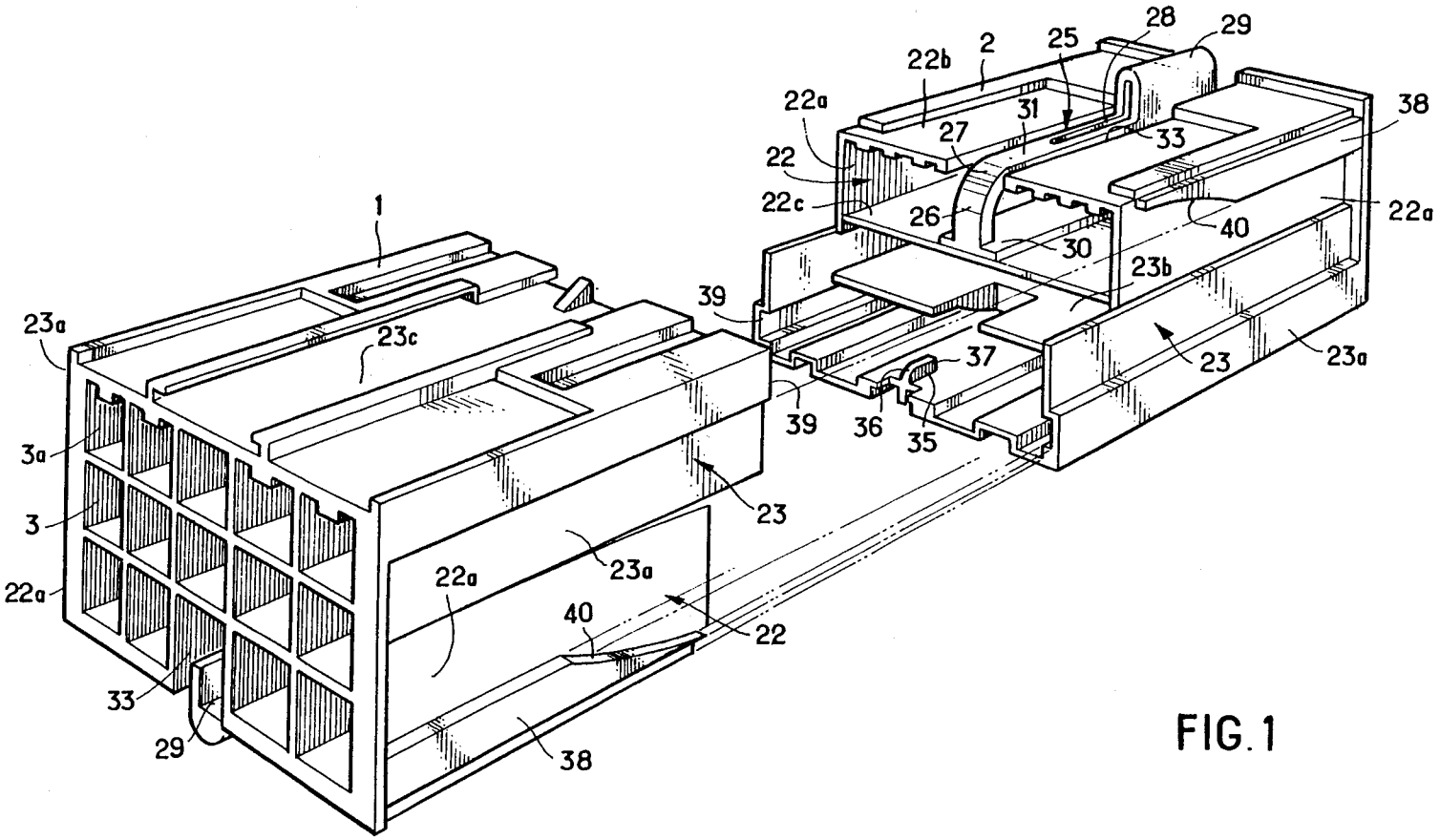
FIG. 1 is a diagrammatic perspective view illustrating the electrical two box-like electrical connectors adapted to connect two electrical contact components.

The electrical connector of the present invention is of the type referred to as a "hermaphroditic" connector comprising two substantially identical box elements. One of these elements is turned head-to-tail on top of the other when the two box elements are assembled with each other. In addition, each element comprises a male portion adapted to be inserted in a female portion of the other element, and each element comprises a female portion adapted to receive a male portion of the other element. The male portion comprises two lateral walls and two additional walls, and the female portion also comprises two lateral walls and two additional walls. Each of the male and female portions comprise a plurality of channels adapted to receive a component of an electrical contact which is linked to an electrical conductor. The electrical contacts which are housed in the channels of the male portion are complimentary in shape to those in the channels of the female portions. Also, the connector is provided with locking means for maintaining these connector box elements assembled to each other.

The female portion of each box element comprises a slide on each lateral wall, and each male portion of each box element comprises a projecting bar on each lateral wall of the male element which is adapted to engage the slides. Each bar is provided at its free end of the sliding ramp, and the additional wall of the male portion opposite to the additional wall which is adjacent to the female portion comprises a locking lug having an elastic section connected to this opposite additional wall. Also, this locking lug comprises a rigid rounded section. In addition, one of the additional walls of the female portion which corresponds to the additional wall of the male portion having the locking lug thereon is provided with a joggle adapted to engage the locking lug of the other box element during the assembly of these two box elements. The position of the joggle, the locking lug, and the slanting ramps is such that at the beginning of the assembly of the box elements, the joggle slides up the rounded section and causes a movement of the two box elements in diverging directions substantially perpendicular to an insertion axis along which one of the box elements is displaced with respect to the other to assemble the two box elements. In addition, after the joggle has slid up the rounded part, the slides engage the ramps to bring the elements into a normal assembly position.

As a result of this arrangement, there will be an accurate insertion and engagement of the electrical contact components housed in the two box elements.

In addition, according to one characteristic of the invention, the male portion comprises a housing in which the elastic locking lug extends. According to another detail of the invention, the elastic locking lug has an intermediate slot in which the joggle inserts itself so as to provide a locked position for the two boxed elements in which the two boxed elements are locked into assembly with each other. In this embodiment, the joggle has at its end toward the inside of the box element, a stop, and the locking lug has a boss on its side opposite from the rounded portion. As a result, an accurate, efficient, and simple locking of the two box elements can be achieved in a releasable fashion because when the boss is pressed downwardly, the elastic lug releases the joggle and disconnects the two elements.

The components of the electrical contacts which are adapted to be used with such an electrical connector are "hermaphroditic" and are formed from a body provided at one end with means for attachment to an electrical conductor. The body comprises a rectangular section comprising a wall having an extension folded inwards and comprises at its end an elastic tab turned toward the extension.

It should be noted that in the different figures the box-like electrical connectors and the components of the electrical contacts are both hermaphroditic, i.e. these elements are adapted to engage identical elements. However, it should be understood that it is within the scope of the present invention to use conventional male or female components of the electrical contacts with the connector of the present invention, and it is also within the scope of the present invention to use box-like connectors that are either male or female and which are adapted to engage each other.

The box connector illustrated in FIG. 1 is formed from two identical box elements 1 and 2 which can be assembled one on top of the other after one of these elements has been turned in a head-to-tail upside down with respect to the other.

Each box element 1, 2 comprises a male portion 22 comprising lateral walls 22*a*, 22*a* and additional walls 22*b* and 22*c*. Each box element 1, 2 also comprises a female portion 23, comprising lateral walls 23*a*, 23*a*, and additional walls 23*b* and 23*c*. Wall 22*b* of male portion 22 is adjacent to female portion 23, and additional wall 23*b* of female portion is adjacent to male portion 22.

Male portion 22 comprises a plurality of channels 3 each of which, are adapted to receive an electrical contact component 4. Female portion 23 comprises as plurality of channels 3*a*, each of which are adapted to receive an electrical contact component 4.

Figure 2:
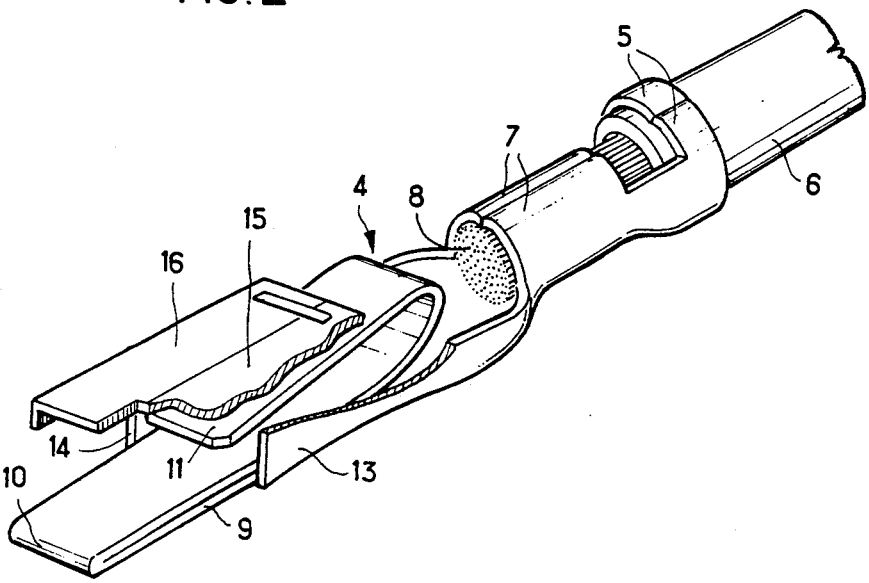
FIG. 2 is a perspective view of an electrical connector component which is adapted to be positioned and housed in the electrical connectors illustrated in FIG. 1.

FIG. 2 illustrates electrical contact component 4. Component 4 is composed of a metal that is a good conductor of electricity and which has a certain elasticity. Component 4 comprises at one end lugs 5 adapted to tighten on a sleeve 6 of a conductor 8. Also, component 4 further comprises lugs 7 which are adapted to tighten a corresponding stripped end of the conductor. Component 4 also comprises a floor wall 9 comprising an extension 10 folded to form an elastic tab 11. Also provided are two lateral walls 13 and 14 which are attached to flaps 15 and 16, respectively. Flaps 15 and 16 extend from lateral walls 13 and 14 inwardly so that flaps 15 and 16 extend substantially parallel to floor 9 and above floor 9. Flaps 15 and 16, lateral walls 13 and 14, and floor 9 together comprise a substantially rectangular section or duct.

Electrical contact component 4 is adapted to receive a simple male bar, which is to be inserted between extension 10 and tab 11. Alternatively, component 4 is adapted to engage an identical component 4 which is turned head-to-tail upside down with respect to component 4 so that extension 10 of this inverted component 4 is inserted against and between extension 10 and elastic tab 11 of the non-inverted component 4. In addition, extension 10 of non-inverted component 4 is inserted in the same way between extension tab 10 and tab 11 of inverted component 4.

Figure 3:
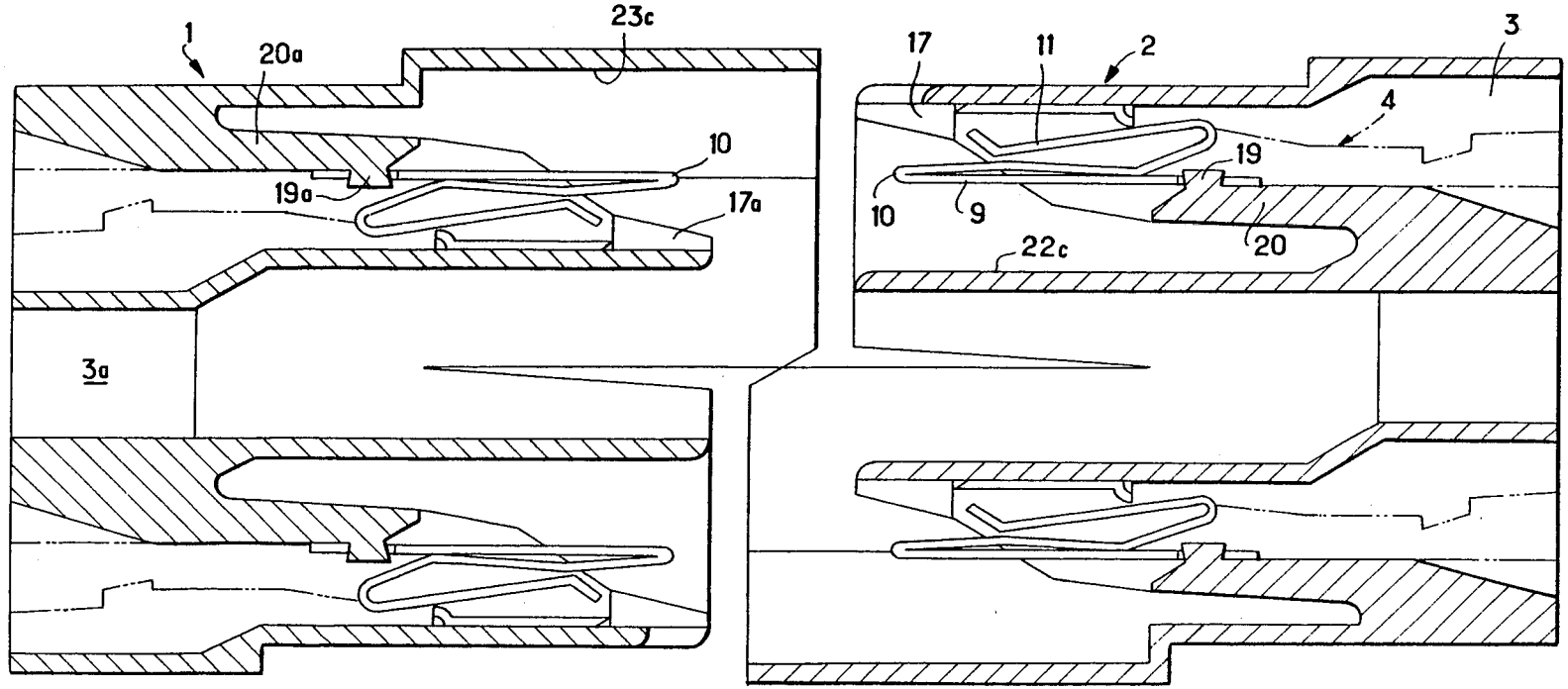
FIG. 3 is a cross-sectional view along line III—III of FIG. 1.

As illustrated in FIG. 3, floor wall 9 has, near lugs 7, a hole 18 adapted to receive a joggle 19 carried by an elastic lug 20 provided in each channel 3 of each box element 1, 2. Each channel 3 also comprises a stop 17 against which the free end of flaps 15, 16 abuts.

It should be noted that each male portion comprises a plurality of channels 3, and that similarly each female portion of each box member comprises a plurality of channels, each of which are denoted by **3*a*. Each channel 3*a* is identical to channel 3 in the male portion of the box element. As a result, each channel 3*a* also comprises a joggle 19*a* carried by a locking lug 20*a* which is adapted to engage a hole 18 in floor 9 of component 4. Also, each channel 3*a* comprises a stop 17*a* against which the free end of flaps 15, 16** abuts.

In this way, when contact component 4 is installed in a channel 3, it is locked therein. Also, when a contact component 4 is inserted into a channel **3*a* it is also locked therein. It should be noted that each channel 3*a* of female portion 23 is substantially identical to each channel 3, but, each channel 3*a* is formed to allow male portion 22 to be inserted into female portion 23 as will be discussed below. As a result, additional wall 23*b* of female portion 23 does not, near its free end, contact lateral walls 23*a* in order to allow lateral walls 22*a* of male portion 22 to engage female portion 23. Also, female portion 23 forms a free space 24 to enable wall 22*c* to press under wall 23*b***.

Male portion 22 of each element 1, 2 is also provided with an elastic locking lug 25 having an end 26 which is integral with a rib 30 of wall **22*c*. Also, locking lug 25 comprises a stiff rounded portion 27 and an elastic portion 31 extending from rounded portion 27 in a direction opposite from ends 26. Elastic portion 31 is pierced with a slot 28. Also provided is a boss 29 attached to elastic portion 31 so that slot 28 is positioned between elastic portion 31 and boss 29. Elastic locking portion 25 is positioned in a housing 33 formed in a central portion of wall 22*b* of each element 1,2**.

Wall **23*c* comprises a joggle 35 having a rounded portion 36 and a stop 37. Joggle 35 is located in a plane passing through elastic locking lug 25**.

Lateral walls **22*a* of male portion 22 each comprise, near wall 22*b*, a guiding or projecting bar 38 having a slanting ramp 40 thereon. In a complimentary fashion, lateral walls 23*a* and female portion 23 are provided with slides 39. Slides 39 of element 1 are adapted to receive bars 38 of element and 2**, and vice versa.

It will also be seen from FIG. 1 that joggle 35 is slightly set back in relation to the forwardmost edge of wall **23*c***.

Although electrical components are manufactured with maximum care and connector boxes 1 and 2 are also manufactured with a high standard of accuracy, when element 1 is assembled into element 2, extensions 10 of both components 4, (one extension 10 being housed in channel 3, and the other extension 10 being housed in a corresponding channel of the other box element) abut against one another. When this occurs, either one cannot assemble elements 1 and 2, or in order to assemble elements 1 and 2 these elements must be forced into engagement which can damage one of the components, thereby resulting in an imperfect electrical connection. This is especially true when the elements are small.

Figure 4:
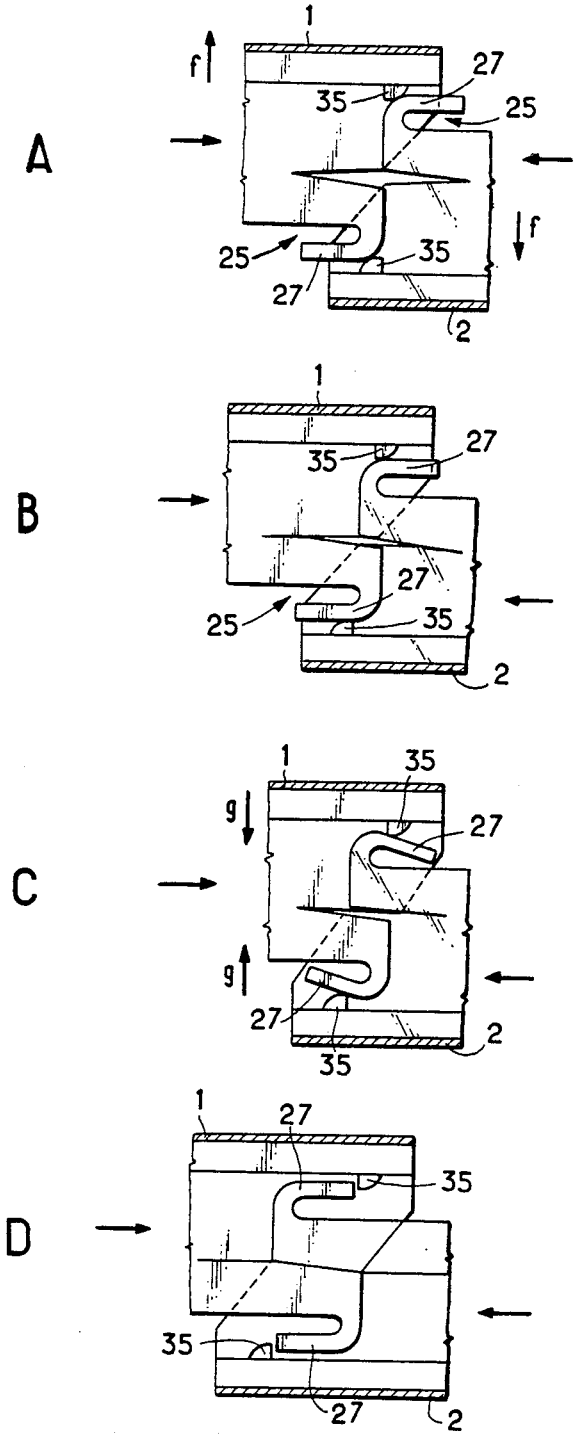
FIGS. 4A–D illustrates a schematic diagram of the various locking phases of the box-like electrical connector.
Figure 5:
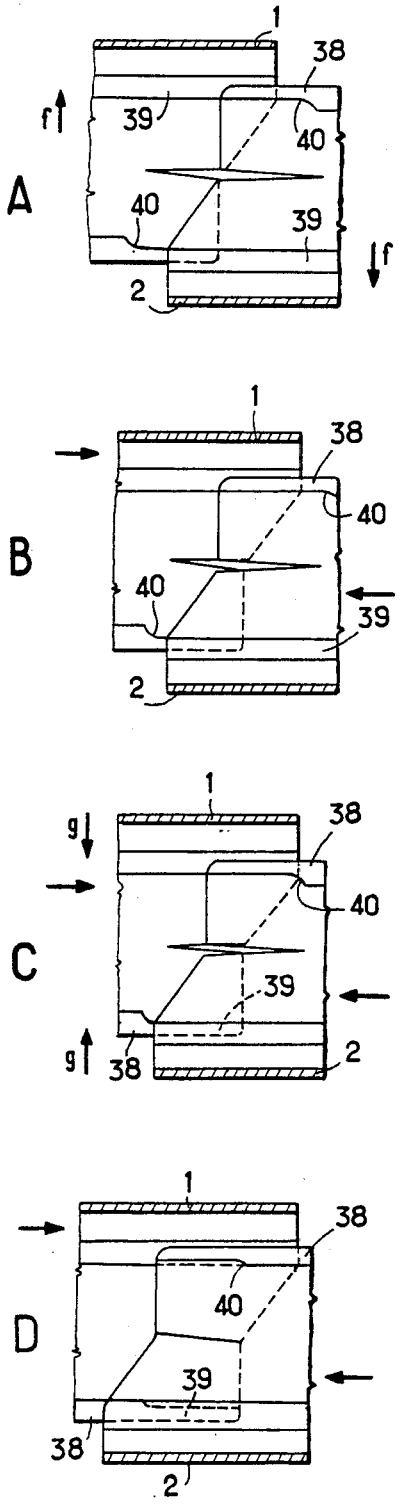
FIGS. 5A–D illustrates a schematic diagram showing the guiding of two identical electrical connectors during assembly.
Figure 6:
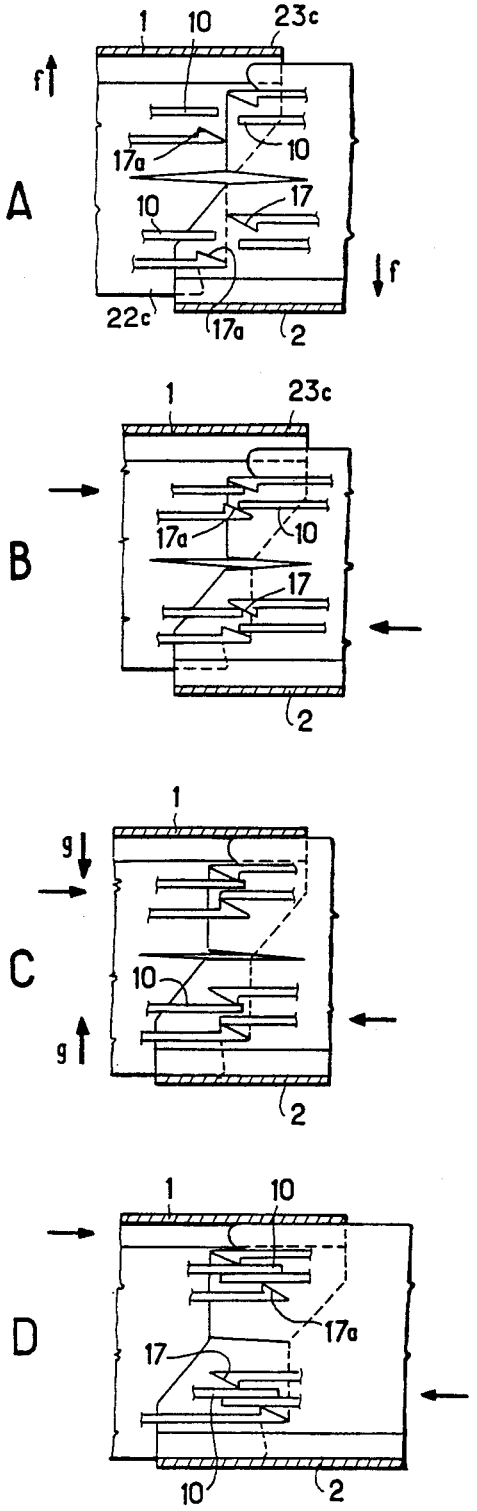
FIGS. 6A–D illustrates a schematic view of the insertion phases of the electrical contact components in which two electrical contact components engage each other during assembly of the electrical connectors.

The present invention prevents this undesirable event from occurring, as will now be explained, with reference to FIGS. 4, 5 and 6.

When elements 1 and 2 are positioned to fit together, i.e. when one is inverted with respect to the other, head-to-tail upside down, and when elements 1 and 2 are displaced toward each other along an insertion or engagement axis, male portion 22 of one of these elements engages a female portion 23 of the other of these elements until joggles 35 abut against rounded portions 27 of elastic locking lugs 25. In this position guide bars 38 are just slightly engaged in slides 39 at their ends which are provided with a ramp. This is illustrated in FIG. 4A and 5A. In this position extensions 10 are spaced apart from each other both vertically and horizontally as is illustrated in FIG. 6A. This position is the normal assembly position of elements 1 and 2, in which extensions 10 in elements 1 and 2 will abut each other if insertion is completed.

If insertion is continued along the engagement or insertion axis joggles 35 climb up rounded portion 27. This movement is possible because it is only the ends of ramp 40 that engage slides 39 at this point so that there is a great amount of slack between slides 39 and ramp 40. As a result, displacement of elements 1 and 2 occurs in opposite directions perpendicular to the insertion or engagement axis in the direction illustrated by arrow f in FIG. 4A. The actual displacement of elements 1 and 2 in diverging directions is illustrated FIG. 4B. The partial engagement of a portion of ramps 40 with slides 39 is shown in FIG. **5*b*. As a result of this perpendicular displacement of elements 1 and 2, extensions 10 of component 4 in channels 3 and 3*a* of elements 1 and 2 are vertically displaced away from each other as extensions 10 move closer together along the insertion axis, as illustrated in FIG. 6B**.

By continuing the insertion of elements 1 and 2 along the insertion axis, elements 1 and 2 remain at the same level, i.e. they continue to be positioned away from the normal assembly position illustrated in FIGS. 4A, 5A, and 6A until joggles 35 pass completely over rounded parts 27 of locking lugs 25 and until ramps 40 completely engage slides 39.

When joggles 35 pass completely over rounded portions 27, joggles 35 contact the elastic portion 31 of lug 25. Because this portion is elastic, it will bend downwardly so as to displace elements 1 and 2 toward each other as illustrated in FIG. 4C in the direction of arrows g. In this position, guide bars 38 engage slides 39 at the level of ramp ends 40 as is illustrated in FIG. **5*c*. As a result, elements 1 and 2 are moved toward each other in opposite directions back into their normal assembly position. In the normal assembly position, extensions 10 are substantially adjacent one another as is illustrated in FIG. 6C. Continued displacement of elements 1 and 2 toward each other along the insertion axis results in joggles 35 falling into slots 28, which is illustrated in FIG. 4D. In this position elements 1 and 2 are locked into engagement with each other. In addition, in this position ramps 40 completely engage slides 39 and extensions 10** are adjacent to each other and make firm contact with each other along a portion of their length as illustrated in FIG. 6D.

To separate elements 1 and 2 one simply presses boss 29 downwardly, which frees joggles 35 from slots 28 so that elements 1 and 2 can then be pulled in opposite directions to disassemble elements 1 and 2.

The invention thus avoids improper positioning of the electrical contact components at the very beginning of the assembly of the connectors. Further, the present invention eliminates the risks of an improper electrical connection between corresponding electrical contact components of two complimentary box elements.

It should be understood that the although the invention has been described with respect to particular means, methods and embodiments, that the invention is not limited thereto, but extends to all equivalents within the scope of the claims, and that numerous modifications can be made within the scope of the invention, which is only limited by the attached claims.

What is claimed is:

1. An electrical connector comprising:

a first element adapted to receive at least one electrical contact and adapted to be connected to a second substantially identical element by displacement of said first and second elements toward each other along an engagement axis, wherein said first element comprises:

(i) a male portion; and (ii) a female portion, wherein said male portion is adapted to engage a female portion on said second element substantially identical to said female portion on said first element, wherein said female portion of said first element is adapted to receive a male portion of said second element substantially identical to said male portion of said first element, wherein said male and female portions of said first element together comprise means for displacing said first and second elements in diverging directions substantially perpendicular to said engagement axis in response to said first and second elements being displaced toward each other along said engagement axis so that said male portion of said first element engages said female portion of said second element and said female portion of said first element receives said male portion of said second element, wherein said first and second elements are adapted to be positioned in a normal assembly position in which an electrical contact housed in said first element is adapted to engage an electrical contact housed in said second element, wherein said connector further comprises means for displacing said first and second elements into said normal assembly position after said first and second elements are displaced in said diverging direction by said male and female portions.

2. The connector defined by claim 1 in combination with said second element.

3. The connector defined by claim 1 wherein as said first and second elements are displaced toward each other along said engagement axis said first and second elements are displaced from a first position to a second position and then to a third position along said engagement axis, wherein said first element further comprises means for engaging a complementary shaped portion on said second element during displacement along said engagement axis, wherein in said first position said engagement means on said first element begins to contact said complementary shaped element on said second element, wherein at said first position said first and second elements are in their normal assembly position, wherein in said second position said male and female portions of said first element displace said first and second elements in opposite directions substantially perpendicular to said engagement axis and away from said normal assembly position, wherein said normal assembly position displacing means comprises means for displacing said first and second elements back into said normal assembly position in response to displacement of said first and second elements from said second position to said third position along said engagement axis beyond said first position.

4. The connector defined by claim 3 wherein said diverging direction displacement means comprises a joggle on said female portion of said first element and a locking lug on said male portion of said first element, wherein said joggle of said first element engages a locking lug on a male portion of said second element and said locking lug of said first element engages a joggle on a female portion of said second element so that the engagement of said locking lugs and said joggles of said first and second elements displaces said first and second elements in diverging directions substantially perpendicular to said engagement axis.

5. The connector defined by claim 4 wherein said male portion comprises two lateral walls each comprising a projecting bar comprising a free end comprising a ramp, wherein said female portion comprises two lateral walls each comprising a slide having a shape complementary to said projecting bar, wherein said slide of said first element is adapted to slidingly receive a projecting bar of said second element in response to displacement of said second element along said engagement axis, wherein said bar of said first element is adapted to slidingly engage a slide on said second element, wherein said engagement means comprises said projecting bar and said slide of said first element, wherein said first and second elements are displaced into said normal assembly position in response to displacement of said elements from said second to said third position, thereby sliding said ramp of one of said elements into said slide of the other of said elements.

6. The connector defined by claim 5 wherein said first element comprises means for connection to a second element substantially identical to said first element by inverting said first element head-to-tail upside down with respect to said second element, wherein in said inverted position said bar of said first element is adapted to slidingly engage a slide of said second element and said slide of said first element is adapted to slidingly engage a bar of said second element.

7. The connector defined by claim 6 wherein said locking lug and said joggle of said first element comprise means for displacing said first and second elements in opposite directions substantially perpendicular to said engagement axis.

8. The connector defined by claim 7 wherein in said inverted position of said first element with respect to said second element said joggle of said first element is adapted to slidingly engage said locking lug of said second element.

9. The connector defined by claim 8 wherein in said inverted position of said first element with respect to said second element said locking lug of said first element is adapted to slidingly engage said joggle of said second element, wherein in said inverted position of said first element with respect to said second element said ramp of said first element is adapted to slidingly engage said bar of said second element.

10. The connector defined by claim 8 wherein said locking lug comprises:

an elastic portion; and a stiff rounded portion connected to and extending in front of said elastic portion, wherein said joggle of said second element first contacts said stiff rounded portion and then contacts said elastic portion in response to displacement of said first and second elements from said second to said third positions, wherein as said first and second elements first contact each other during assembly said joggle climbs said rounded portion, thereby displacing said first and second elements in opposite directions perpendicular to said engagement axis, wherein after said joggle has climbed said stiff rounded portion and said elements are positioned in said third position said ramps of said first and second elements engage said slides of said second and first elements, respectively, so as to position said first and second elements in their normal assembly position.

11. The connector defined by claim 10 wherein said male portion comprises two additional walls spaced apart from each other, wherein one of said additional walls is adjacent said female portion, wherein the other of said additional walls is opposite from said wall adjacent said female portion, wherein said stiff rounded portion of said lug is connected to said one of said additional walls.

12. The connector defined by claim 11 wherein said female portion further comprises two additional walls, spaced apart from each other, wherein one of said additional walls of said female portion is adjacent said male portion, wherein the other of said additional walls of said female portion is opposite from said wall adjacent said male portion and comprises an internal face, wherein said joggle is connected to said internal face of said other of said additional walls of said female portion.

13. The connector defined by claim 12 wherein said male and female portions each further comprise a plurality of channels, wherein each channel comprises means for receiving and housing a component of an electrical contact linked to an electrical conductor, wherein each contact housed in said male portion has a complementary shape to said contact housed in said female portion.

14. The connector defined by claim 13 in combination with said electrical contact.

15. The connector defined by claim 13 further comprising locking means for maintaining said first element assembled with said second element.

16. The connector defined by claim 15 wherein said male portion comprises a housing for housing said elastic portion of said lug and in which said elastic portion extends.

17. The connector defined by claim 16 wherein said lug further comprises an intermediate slot wherein as said first and second elements are displaced toward each other along said engagement axis said first and second elements are displaced from said third position to a fourth locked position along said engagement axis, wherein said joggle of said second element engages said slot and said slot of said first element engages said joggle of said second element after said joggles of said first and second elements have climbed said stiff rounded portion of said second and first elements, respectively, and after said first and second element are displaced from said third to said fourth position, wherein said joggle and said slot comprise said locking means, wherein said locking means locks said first and second elements in said locked position in response to engagement of said slot of said first element with said joggle of said second element and engagement of said joggle of said first element with said slot of said second element.

18. The connector defined by claim 17 wherein said lug further comprises a boss, wherein said slot is positioned between said boss and said stiff rounded portion, wherein said boss comprises means for freeing said joggle from said slot so as to unlock said first and second elements in response to pressing said boss downwardly.

19. The connector defined by claim 18 wherein said joggle further comprises:

a rounded portion facing the exterior of said first element;

an end facing the inside of said first element; and a stop positioned at said end and opposite from said rounded portion of said joggle.

20. The connector defined by claim 19 wherein said electrical contact is an hermaphroditic electrical contact comprising one body having an end including means for attaching said contact to an electric conductor, wherein said body further comprises a rectangular section having a floor wall comprising an extension folded toward the inside of said body, wherein said contact further comprises an elastic lug turned toward said extension.

21. The connector defined by claim 20 in combination with at least one said hermaphroditic electrical contact.

22. The connector defined by claim 21 wherein each contact comprises an opening therein, wherein each channel comprises an elastic lug comprising a joggle adapted to engage said opening to lock said contact in said channel.

23. The connector defined by claim 22 wherein each contact comprises a free end, wherein each channel further comprises a stop adapted to abut said free end.

24. The connector defined by claim 23 wherein said one of said additional walls of said female portion comprises a free end spaced from said lateral walls of said female portion.

25. The connector defined by claim 24 wherein said other of said additional walls of said male portion comprises a central portion, wherein said housing is positioned in said central portion of said other of said additional walls.

26. The connector defined by claim 25 wherein said joggle of said female portion is positioned in a plane passing through said locking lug of said male portion, wherein said other of said additional walls of said female portion comprises a free end having a forwardmost edge, wherein said joggle is spaced behind said forwardmost edge of said free end of said other of said additional walls of said female portion.

27. The connector defined by claim 26 in combination with said second element, wherein said first and second elements are substantially box-shaped.

28. A hermaphroditic electrical connector comprising:

a first element adapted to receive electrical contacts, and adapted to be assembled with a second element having structure substantially identical to said first element by displacement of said first element and second element toward each other along an engagement axis, wherein said first element is adapted to engage said second element when said second element is turned head-to-tail upside down with respect to said first element, wherein said first element comprises:

(a) a male portion comprising:

a locking lug comprising an elastic portion and a stiff rounded portion, wherein said male portion comprises means for engaging a female portion of said second element; and (b) a female portion comprising:

a joggle, wherein said female portion comprises means for receiving a male portion of said second element, wherein said joggle of said first element comprises means for engaging said lug of said second element during assembly of said first and second elements wherein said lug of said first element comprises means for engaging said joggle of said second element during assembly of said first and second elements, wherein the position of said joggle and said locking lug is such that at the beginning of the assembly of said first and second elements said joggle of said first element climbs said stiff rounded portion of said second element, thereby displacing said first and second elements in diverging directions substantially perpendicular to said engagement axis.

29. The connector defined by claim 28 wherein said male portion of said first and second elements further comprise at least one projecting bar comprising a sliding ramp, wherein said female portion of said first and second elements further comprises at least one slide, wherein said at least one projecting bar and said at least one slide are so positioned that:

said at least one projecting bar of said first element comprises means for engaging said slide of said second element;

said at least one slide of said first element comprises means for receiving said at least one bar of said second element; and said ramp of said first element fits into said slide of said second element to bring said first and second elements into a normal assembly position in which an electrical contact attached to said first element engages an electrical contact attached to said second element.

30. The connector defined by claim 29 in combination with said second element, wherein said joggle of said second element comprises means for engaging said lug of said first element during assembly of said first and second elements, wherein said lug of said second element comprises means for engaging said joggle of said first element during assembly of said first and second elements, wherein the position of said joggle, said locking lug, said slide and said bar of said first and second elements is such that at the beginning of the assembly of said first and second elements said joggle of said second element climbs said stiff rounded portion of said first element, thereby displacing said first and second elements in diverging directions substantially perpendicular to said engagement axis, wherein said at least one projecting bar of said second element comprises means for engaging said slide of said first element, wherein said at least one slide of said second element comprises means for receiving said at least one bar of said first element, wherein said ramp of said second element fits into said slide of said first element to bring said first and second elements into a normal assembly position in which an electrical contact attached to said first element engages an electrical contact attached to said second element.

31. The connector defined by claim 30 wherein said first and second elements comprise first and second box elements and means for locking said first and second elements in an assembled position, wherein said male and female portions of said first and second elements each further comprise:

first and second lateral walls;

third and fourth additional walls;

a plurality of channels, each channel comprising means for receiving a component of an electrical contact linked to an electrical conductor, wherein said electrical contacts housed in said male portions have a shape complementary to the shape of said electrical contacts housed in said female portions, wherein each of the lateral walls of said male portion comprises one projecting bar, wherein each of the lateral walls of said female portion comprises one slide, wherein a third wall of said male portion is adjacent said female portion and comprises said locking lug, wherein said fourth wall of said female portion corresponds to said fourth wall of said male portion and comprises an internal face on which said joggle is positioned.

* * * * *

UNITED STATES PATENT AND TRADEMARK OFFICE

CERTIFICATE OF CORRECTION

PATENT NO. : 4,734,052

DATED : March 29, 1988

INVENTOR(S) : Bertrand Vandame

It is certified that error appears in the above-identified patent and that said Letters Patent is hereby corrected as shown below:

At column 1, line 36, change "complimentary" to ---complementary---.

At column 2, lines 56 and 60, change "complimentary" to ---complementary---.

At column 3, line 21, change "complimentary" to ---complementary---.

At column 6, line 7, delete "above" after "defined".

At column 6, line 40, change "complimentary" to ---complementary---.

At column 7, lines 18 and 21, change "illustrates" to ---illustrate ---.

At column 7 line 44, change "complimentary" to ---complementary---.

At column 9, line 65, change "complimentary" to ---complementary---.

At column 10, line 46, insert ---in--- after "illustrated".

At column 11, line 22, change "complimentary" to ---complementary---.

At column 11, line 23, delete "the" after "that".

Signed and Sealed this

Fourth Day of October, 1988

*Attest:*

*Attesting Officer*

DONALD J. QUIGG

*Commissioner of Patents and Trademarks*